US007552678B2

(12) United States Patent
Doeres et al.

(10) Patent No.: US 7,552,678 B2
(45) Date of Patent: Jun. 30, 2009

(54) REGISTRATION CORRECTION SYSTEM

(75) Inventors: Hans-Juergen Doeres, Frammersbach (DE); Stephan Schultze, Lohr (DE)

(73) Assignee: Bosch Rexroth AG, Stuttgart (DE)

( * ) Notice: Subject to any disclaimer, the term of this patent is extended or adjusted under 35 U.S.C. 154(b) by 210 days.

(21) Appl. No.: 11/485,757

(22) Filed: Jul. 13, 2006

(65) Prior Publication Data

US 2007/0017398 A1 Jan. 25, 2007

(30) Foreign Application Priority Data

Jul. 19, 2005 (DE) ..... 10 2005 033 585

(51) Int. Cl.
*B41F 13/24* (2006.01)

(52) U.S. Cl. ..... 101/248; 101/481

(58) Field of Classification Search ..... 101/221, 101/480, 483, 484; 399/66, 101, 301, 302
See application file for complete search history.

(56) References Cited

U.S. PATENT DOCUMENTS

| | | | | |
|---|---|---|---|---|
| 5,606,913 | A * | 3/1997 | Kowalewski | 101/183 |
| 6,832,060 | B2 * | 12/2004 | Tanaka et al. | 399/66 |
| 2005/0132918 | A1 | 6/2005 | Schultze et al. | |
| 2006/0005722 | A1 * | 1/2006 | Nobukawa et al. | 101/181 |
| 2007/0017398 | A1 * | 1/2007 | Doeres et al. | 101/484 |

FOREIGN PATENT DOCUMENTS

| | | |
|---|---|---|
| DE | 40 37 728 | 6/1992 |
| DE | 44 34 843 | 4/1996 |
| DE | 101 32 266 | 1/2002 |
| DE | 103 60 168 | 7/2005 |

* cited by examiner

*Primary Examiner*—Daniel J Colilla
*Assistant Examiner*—David Banh
(74) *Attorney, Agent, or Firm*—Michael J. Striker

(57) ABSTRACT

In a method for registration correction for a multicolor rotary printing press in an acceleration phase, having at least one registration correction device with correction parameters for operation of constant speed, and having a motion controller for controlling the print roller speed, if the registration correction device is acted upon in the acceleration phase by at least one fixed set of the correction parameters, which differs from the correction parameters at constant speed, and/or in the acceleration phase, a correction profile that is modified compared to constant speed is used, and/or information about the presence of the acceleration phase is supplied by the motion controller to the registration correction device, then it can be attained that in both methods, during the acceleration phase, the corrector continues to remain active, and even in this phase, it compensates for registration deviations. By the set of correction parameters that is modified compared to constant speed, or correction values, the registration corrector can be optimally adapted to requirements during the acceleration phase, and thus minimal registration offset can be attained. After the acceleration phase, the correction parameters or correction values are reset to the values before the acceleration phase for constant speed.

8 Claims, 2 Drawing Sheets

REGISTRATION CORRECTION SYSTEM

CROSS-REFERENCE TO A RELATED APPLICATION

The invention described and claimed hereinbelow is also described in German Patent Application DE 10 2005 033 585.3-27 filed on Jul. 19, 2005. This German Patent Application, whose subject matter is incorporated here by reference, provides the basis for a claim of priority of invention under 35 U.S.C. 119(a)-(d).

BACKGROUND OF THE INVENTION

The invention relates to a method for registration correction for a multicolor rotary printing press in an acceleration phase, having at least one registration correction device with correction parameters for operation of constant speed, and having a motion controller for controlling the print roller speed.

In multicolor printing in rotary printing presses, the application of the individual color separations, especially for cyan, magenta, yellow, and black, is done in successive printing groups. The material to be printed is furnished in rolls and is guided in endless fashion through the printing unit. A criterion for the print quality achieved is that the printed images of the various colors be located exactly one above the other. This location of the printed images above one another is called registration. For mutual alignment with the various printing groups, in addition to the actual printed image, each printing group prints registration measurement marks, for example in the form of registration crosses. From these marks, an offset between the various printed images can be detected online by an optical measurement system. In rotary printing systems, this measurement system is generally a component of a correction system known as the registration correction system. The registration correction system intervenes in the printing process via suitable final control elements and compensates for the registration deviations detected by the optical measurement system. In particular, the web length of the material to be printed can be varied between successive printing groups by the final control elements in such a way that the printed images of successive printing units are located one above the other.

The cause of deviations among the various imprints are not only the relative position of the printing groups to one another but also changes in the geometry of the material being printed. These changes in geometry are caused for instance by the influence of moisture and by drying steps located between the printing groups.

During the printing process, the web tension is kept the same as much as possible, which makes good print quality without substantial corrections possible. The correction parameters of the registration correction system are adapted to this operating state. Conversely, in both positive and negative acceleration events, the web tension varies, with an adverse effect on the registration precision. This cannot be compensated for adequately by the correction system, which in this phase of operation leads according to rejection. Even after the acceleration phase, the correction system requires a certain time in operation in order to attain the appropriate controlling variables again. Once again, the result can be rejection.

In German Patent DE 40 37 728 C1, an apparatus for registration correction for multicolor rotary printing presses in the web/web method is described, with a corrector with a central unit for detecting all the correction parameters and the correction method and storing them in memory, with a scanner for detecting web registration marks, and with final control elements for correcting the lengthwise registration. The apparatus includes a monitoring unit, which has an acceleration detector that ascertains a change in speed of the printing press, deviating from a stable web speed, at the printing cylinders and which has a shutoff device that is in signal communication with the acceleration detector and which interrupts the correction activity upon the occurrence of a signal representing this change of speed, until a constant operating speed is again achieved.

A disadvantage of this apparatus is that to ascertain the acceleration, an acceleration detector, with at least one suitable speed indicator for detecting the web speed must be provided. Because of the additionally required components, this not only leads to increased system costs but also, because of the necessary cable connection of the speed indicator, to increased installation costs. The costs are increased still further because one such speed indicator must advantageously be provided at each printing group.

Another disadvantage is that often the available space inside the printing unit does not make it possible to mount the speed indicator in a suitable position.

Since during the change of speed the correction activity is interrupted, and the corrector output is fixed at the most recent value before the change of speed, no registration correction is performed during this phase. This leads to an increased registration deviation during the acceleration phase and thus to increased rejection.

SUMMARY OF THE INVENTION

It is the object of the invention to create a registration correction system of the type defined at the outset which makes due with fewer components than in the prior art and minimizes spoilage during and after acceleration phases.

This object is attained in that the registration correction device is acted upon in the acceleration phase by at least one fixed set of the correction parameters, which differs from the correction parameters at constant speed, and/or in the acceleration phase, a correction profile that is modified compared to constant speed is used, and/or information about the presence of the acceleration phase is supplied by the motion controller to the registration correction device. In registration correctors with adjustable correction parameters, a switchover to modified correction parameters is preferably made, while in registration correctors with correction values imposed on it, a modified correction profile is employed.

In both methods, the corrector continues to be active during the acceleration phase and even in this phase compensates for registration deviations. Because of the modified set of correction parameters compared to constant speed, or correction values, the registration corrector can be adapted optimally to requirements during the acceleration phase, and thus only minimal registration offset is achieved. After the acceleration phase, the correction parameters or correction values are reset to the values for constant speed that applied before the acceleration phase.

The information about the presence of an acceleration phase is available to the motion controller of the rotary printing press and can be furnished from there to the registration controller. Additional speed sensors for detecting the acceleration phase can thus be dispensed with, which leads to reduced component, assembly, and cable connection costs. This is especially true since advantageously the acceleration in all the printing groups of the printing unit is detected, and thus at the same time a plurality of speed sensors can be dispensed with. A further advantage is due to the fact that ascertaining an acceleration phase is possible even in rotary printing presses that have printing groups in which there is no space available for speed sensors.

The information furnished by the motion controller about the acceleration phase can be used both for replacing the correction parameters or the correction profile, or for a reaction known from the prior art, such as freezing the corrector output during the acceleration phase.

If a more-dynamic set of correction parameters is used in the acceleration phase than at constant speed, then the registration corrector can compensate faster for registration deviations that occur during the change of speed. This can be associated with somewhat poorer print quality.

Conversely, if in the acceleration phase a less-dynamic set of correction parameters than at constant speed is used, this leads to markedly slighter adjusting motions, yet the corrector continues to be active. The control loop remains stable; registration deviations are compensated for, but the final control elements are not adjusted too far from their position at constant speed, which after the acceleration phase means that optimal operating conditions can rapidly be restored.

A simple exchange of data between the motion controller and the registration corrector is attained by providing that the information about the presence of the acceleration phase, the acceleration signal, is supplied as a binary signal by the motion controller to the registration correction device. For example, the signal can be carried to an external registration corrector via a field bus, or if the registration corrector and the motion controller are integrated into the same control hardware, it can be supplied directly, for instance via an internal bus system. In modern motion controllers, binary signals are available, such as "set-point speed attained", and can be used without additional provisions. If speed changes dictated by the tool are always carried out with the same acceleration, or if only one possible reaction is contemplated, for example the switchover to a modified set of correction parameters, then one binary signal suffices to describe the acceleration event.

If the acceleration signal is supplied, as a signal proportional to the acceleration, by the motion controller to the registration correction device, then a different reaction can be initiated in accordance with the actual acceleration. For instance for braking during acceleration events, or for variously fast speed changes, different correction profiles can be used. The signal proportional to the acceleration can be carried to the registration corrector as either an analog signal or a digital signal.

The object of the invention is also attained in that information about a beginning and an end of the acceleration phase is supplied by the motion controller to the registration correction device, and that at the beginning of the acceleration phase the controlling variable is stored in memory, and at the end of the acceleration phase the controlling variable is set to the value that is derived from a value at the beginning of the acceleration phase. For instance, the controlling variable can be set to the value present at the beginning of the acceleration phase.

Because the beginning and end of the acceleration phase are reported to the registration correction device by the motion controller, no additional speed transducers are necessary, which leads to corresponding cost advantages. The corrector activity is preserved during the acceleration phase and thus minimizes spoilage. If the controlling variable is reset after the acceleration phase to the value at the beginning of the acceleration phase, or to a value derived from that, then a value of the controlling variable that is suitable for constant speeds is immediately available. This is possible since the controlling variables for different constant speeds are maximally constant, and major deviations from them occur only in acceleration phases. Resetting the controlling variable to the value before the acceleration phase thus leads much faster to a suitable value for the controlling variable at a constant speed than would be the case through the control loop alone by the correction activity of the corrector.

The reaction of the registration correction system to the acceleration information during the acceleration phase can be effected in accordance with the embodiments described above.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
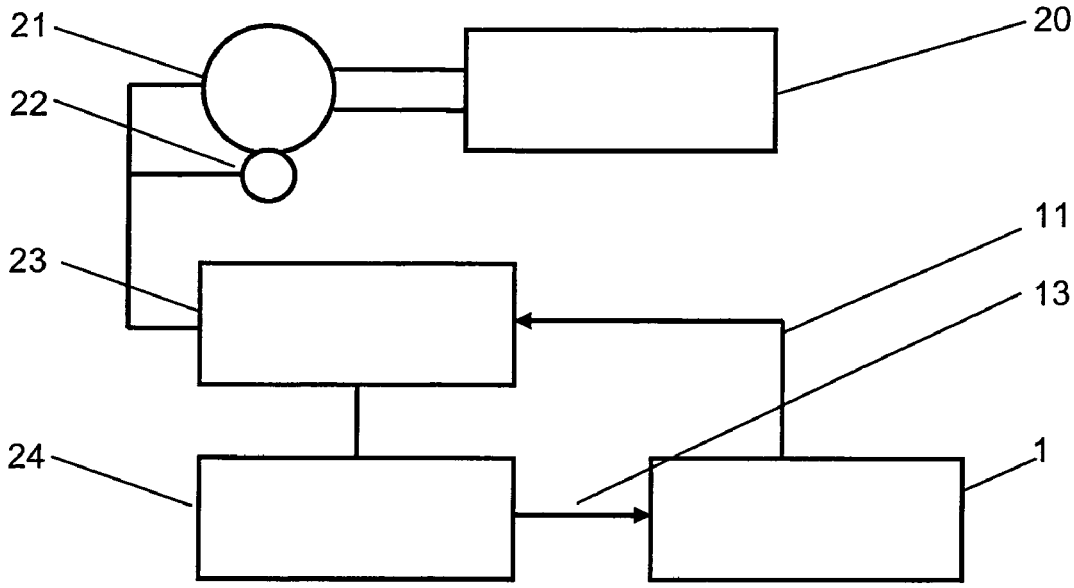
FIG. 1 is a schematic illustration of a motion controller with an external registration correction system.

FIG. 1 shows a registration correction system 1 with a motion controller 24 for a print roller 20 with an external registration correction system 1. The registration correction 1 acts via a controlling variable 11 on a switchover device 23, which supplies a drive motor 21 that in turn moves the print roller 20. The motion of the drive motor 21 is recorded by a rotary angle encoder 22 and is carried onward via the switchover device 23 to the motion controller 24. The registration correction system 1 receives an acceleration signal 13 from the motion controller 24. The acceleration signal 13 may be transmitted in binary form (for instance as a "set-point speed value attained" signal) or as an analog signal that represents the actual value of the acceleration.

Figure 2:
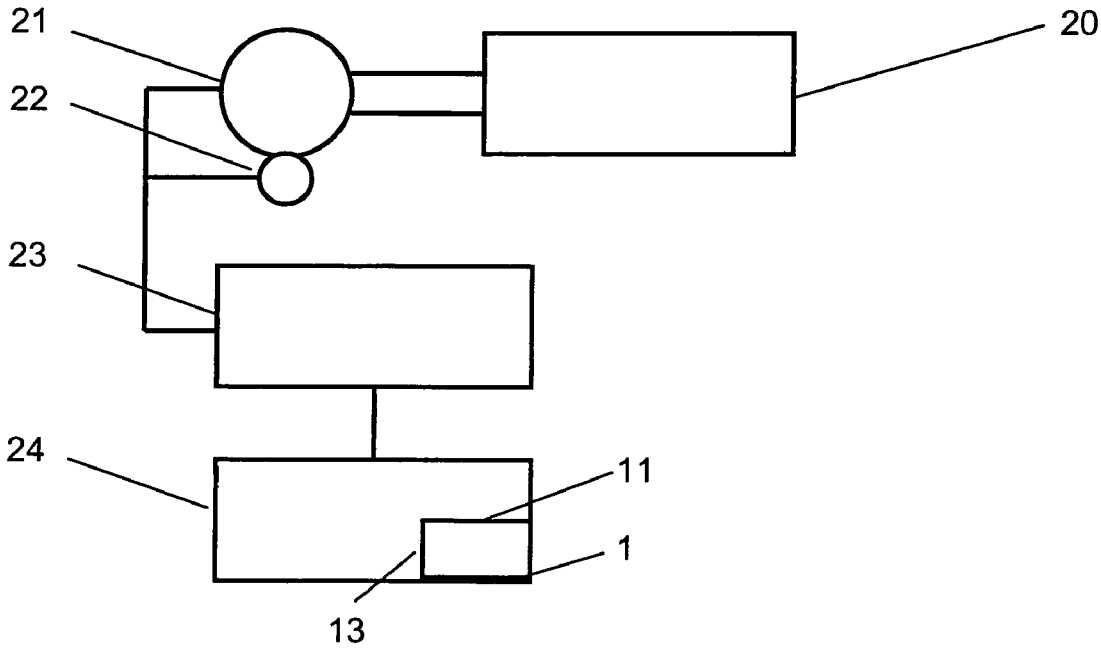
FIG. 2 is a schematic illustration of a motion controller with an internal registration correction system.

FIG. 2 shows a registration correction system 1 that is integrated with the motion controller 24. Both the acceleration signal 13 and the controlling variable 11 occur only within the motion controller 24, making complicated communication between different modules unnecessary. In a refinement, the acceleration signal 13 can be generated simultaneously with the signal for a speed change of the drive. In that case, the chronological offset resulting from the evaluation of the rotary angle encoder 22 can be eliminated.

Figure 3:
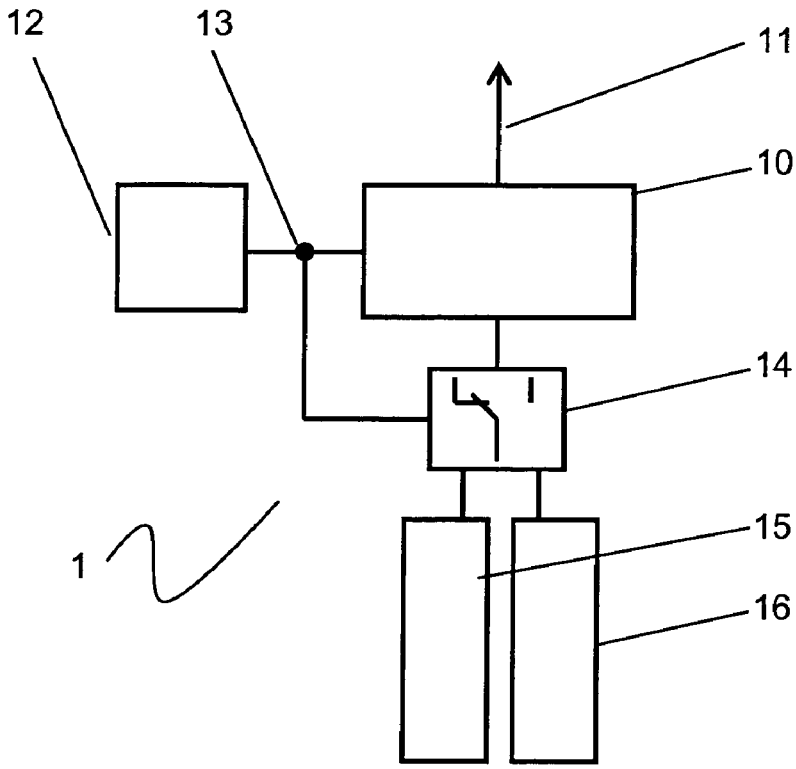
FIG. 3 shows the registration correction system with a switchover between sets of correction parameters.

FIG. 3 shows a registration correction system 1 with a registration correction device 10, which outputs a controlling variable 11 to the higher-order controller. An acceleration transducer 12 outputs the acceleration signal 13 to the registration correction device 10 and to a switchover device 14. At a constant rotary speed of the print roller, a first set of correction parameters 16 acts on the registration correction device 10. If the acceleration signal 13 exhibits a deviation from the constant rotary speed, then the switchover device 14 switches over to a second set of correction parameters 15. These correction parameters 15 may be selected to be more-dynamic, or less-dynamic, than the correction parameters 16 at constant speed.

Figure 4:
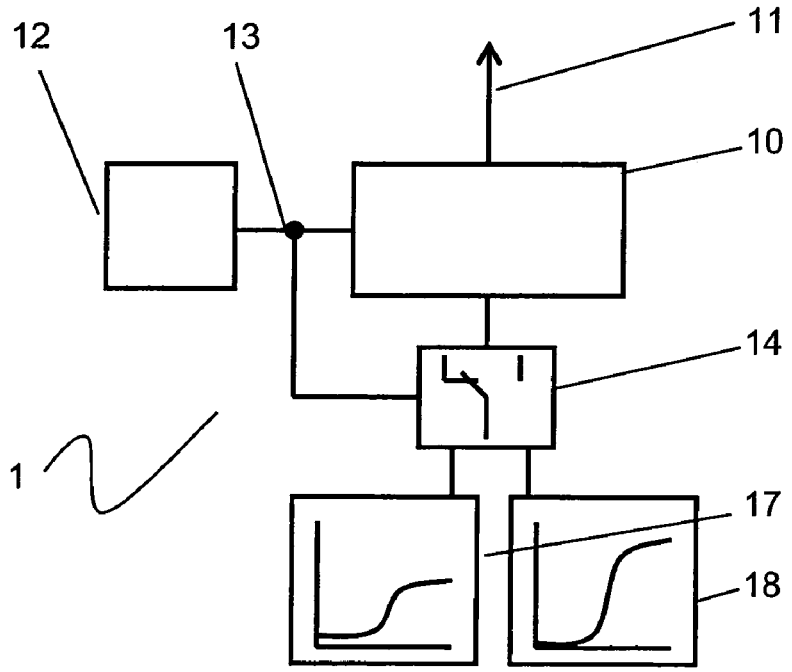
FIG. 4 shows the registration correction system with a switchover between correction profiles.

FIG. 4 shows a registration correction system 1 with a registration correction device 10, in which the switchover device 14 selects between a correction profile 18 at constant speed and a correction profile 17 during an acceleration phase. The acceleration signal 13 can also be used to store the controlling variable 11 in memory at the beginning of the acceleration phase. The registration correction device 10 can then continue to correct during the acceleration phase and can restore the value of the controlling variable 11 at the end of acceleration.

Depending on the intended use, a plurality of provisions may be combined. For instance, the switchover to more-dynamic correction parameters 15 can be advantageously combined with storing the controlling variable 11 in memory at the beginning of the acceleration and restoring it at the end of the acceleration phase.

In summary, by the methods shown or a combination of them, a reduction in rejection in acceleration phases can be achieved.

It will be understood that each of the elements described above, or two or more together, may also find a useful application in other types of constructions differing from the types described above.

While the invention has been illustrated and described as embodied in a registration correction system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A method for registration correction for a multicolor rotary printing press in an acceleration phase, comprising the steps of providing at least one registration correction device with correction parameters for operation of constant speed, which registration correction device furnishes a controlling variable; controlling a print roller speed by a motion controller; supplying information about a beginning and end of the acceleration phase by the motion controller to the registration correction device; and acting upon the registration correction device in the acceleration phase by at least one fixed set of correction parameters which differs from the correction parameters at the constant speed.

2. A method as defined in claim 1; and further comprising using in the acceleration phase a more-dynamic set of correction parameters than at the constant speed.

3. A method as defined in claim 1; and further comprising using in the acceleration phase a less-dynamic set of correction parameters than at constant speed.

4. A method as defined in claim 1; and further comprising supplying the information about the presence of the acceleration phase in acceleration signal as a binary signal, by the motion controller to the registration correction device.

5. A method as defined in claim 1; and further comprising supplying the acceleration signal as a signal proportional to acceleration, by the motion controller to the registration correction device.

6. A method for registration correction for a multicolor rotary printing press in an acceleration phase, comprising the steps of providing at least one registration correction device which furnishes a controlling variable; controlling a print roller speed by a motion controller; supplying information about a beginning and an end of the acceleration phase by the motion controller to the registration correction device; and at a beginning of the acceleration phase storing the controlling variable in memory while at an end of the acceleration phase setting the controlling variable to a value that is derived from a value at the beginning of the acceleration phase.

7. A method as defined in claim 6; and further comprising setting the controlling variable to a value at the beginning of the acceleration phase.

8. A method as defined in claim 6; and further comprising employing, in an acceleration event, a step selected from the group consisting of: acting upon the registration correction device in the acceleration phase by at least one fixed set of correction parameters which differs from the correction parameters at the constant speed; using in the acceleration phase the correction profile that is modified compared to constant speed; supplying information about the presence of the acceleration phase by the motion controller to the registration correction device, and a combination thereof; using in the acceleration phase a more-dynamic set of correction parameters than at the constant speed or using in the acceleration phase a less-dynamic set of correction parameters than at constant speed; and one of: supplying the information about the presence of the acceleration phase in acceleration signal as a binary signal, by the motion controller to the registration correction device; and supplying the acceleration signal as a signal proportional to acceleration, by the motion controller to the registration correction device.

* * * * *